US006435811B1

(12) United States Patent
Beyer et al.

(10) Patent No.: US 6,435,811 B1
(45) Date of Patent: Aug. 20, 2002

(54) FRICTION VACUUM PUMP WITH A STATOR AND A ROTOR

(75) Inventors: Christian Beyer, Cologne; Ralf Adamietz, Wermelskirchen; Markus Henry, Grafschaft; Gunter Schutz, Cologne; Heinrich Engländer, Linnich; Gerhard Wilhelm Walter, Kerpen; Hans-Rudolf Fischer, Erftstadt, all of (DE)

(73) Assignee: Leybold Vakuum GmbH (DE)

( * ) Notice: Subject to any disclaimer, the term of this patent is extended or adjusted under 35 U.S.C. 154(b) by 0 days.

(21) Appl. No.: 09/700,046

(22) PCT Filed: Sep. 11, 1998

(86) PCT No.: PCT/EP98/05802

§ 371 (c)(1),
(2), (4) Date: Nov. 8, 2000

(87) PCT Pub. No.: WO99/60275

PCT Pub. Date: Nov. 25, 1999

(30) Foreign Application Priority Data

May 14, 1998 (DE) ..... 198 21 634

(51) Int. Cl.[7] ..... F03B 5/00

(52) U.S. Cl. ..... 415/90; 415/116; 415/199.5

(58) Field of Search ..... 415/90, 116, 199.5, 415/216.1, 220, 229; 417/423.4, 423.14

(56) References Cited

U.S. PATENT DOCUMENTS

| | | | | |
|---|---|---|---|---|
| 3,189,264 A | | 6/1965 | Becker | |
| 3,628,894 A | | 12/1971 | Ferguson | |
| 3,666,374 A | | 5/1972 | Becker | |
| 5,733,104 A | | 3/1998 | Conrad et al. | |
| 6,030,189 A | * | 2/2000 | Bohm et al. | 417/423.4 |
| 6,106,223 A | * | 8/2000 | Leyshon | 415/90 |
| 6,193,461 B1 | * | 2/2001 | Hablanian | 416/90 |

* cited by examiner

*Primary Examiner*—Edward K. Look
*Assistant Examiner*—Ninh Nguyen
(74) *Attorney, Agent, or Firm*—Wall Marjama & Bilinski LLP

(57) ABSTRACT

The invention relates to a friction vacuum pump (1) with a stator (3) and a rotor (4), which form at least two pump stages (12, 13, 14) with one gas inlet (23, 28) each, as well as with junction for the pump stages, which are equipped with junction openings (36,37) and serve for the connection of the gas inlets (23, 28) of the pump stages with devices to be evacuated; in order to avoid high conductance losses it is proposed that the junction openings (36, 37) are located in a plane which is disposed laterally adjacent to the pump stages (12, 13, 14) such that the distance between the junction openings (36, 37) and the rotor axis (15) is of minimum feasible size.

16 Claims, 2 Drawing Sheets

FRICTION VACUUM PUMP WITH A STATOR AND A ROTOR

BACKGROUND OF THE INVENTION

The invention relates to a friction vacuum pump with a stator and a rotor, which form at least two pump stages with one gas inlet each, as well as junction means for the pump stages, which are equipped with junction openings and serve for connecting the gas inlets of the pump stages with devices to be evacuated.

A friction vacuum pump of this type is known from DE-A-43 31 589. It serves preferably for evacuating particle beam apparatus (for example mass spectrometers) with chambers separated from one another by diaphragms, in which different pressures are to obtain during operation of the particle beam apparatus. It is known per se to use separate vacuum pumps for generating these pressures.

DE-A-43 31 589 discloses generating with the aid of only one vacuum pump system the different pressures required by the particle beam apparatus. The pump system comprises two turbomolecular and one molecular (Holweck) pump stage. These pump stages are disposed such that one axially succeeds the other. Each pump stage comprises a gas inlet (front-side gas penetration area), which, via junction means, is connected with the associated chamber of the device to be evacuated. In the solution according to DE-A-34 31 589 the housing itself and a laterally disposed auxiliary housing serve as junction means. The housing itself is equipped with a front-side junction opening for connecting the gas inlet of the first pump stage with the device to be evacuated. In the auxiliary housing are provided connection lines which connect the associated inlets of the further pump stages with further junction openings. These are each connected, in turn, with the associated chambers in the device to be evacuated. Since the junction openings in the auxiliary housing are located in a common plane (perpendicularly to the rotor axis) with the junction opening of the first pump stage, the connection lines located in the auxiliary housing, must be relatively long. Thereby relatively large conductance losses in the connection lines result, which is in particular of disadvantage if a high suction capacity is desired precisely in the region of an intermediate junction.

SUMMARY OF THE INVENTION

The present invention is based on the task of implementing a friction vacuum pump of the above described type such that the suction capacity of the intermediate stages is not impaired by high conductance losses in connection lines.

This task is solved according to the invention thereby that the junction openings are located in a plane laterally adjacent to the pump stages such that the spacing between the junction openings and the rotor axis is of minimum feasible size.

These measures ensure that the spacing between the particular gas inlet of the intermediate stages and the associated junction openings is also of minimum feasible size. Conductance losses are low. The suction capacity active in the region of the gas inlet of all pump stages is available nearly unchanged even in the region of the associated junction openings.

While realization of the measures according to the invention leads to the fact that the gases to be transported in the inlet region of the first pump stage, thus exactly at that site at which the pressure is lowest, must be deviated, however, the loss in conductance caused thereby can be kept low since the spacing between the gas inlet and the plane of the junction opening still is relatively small and, in addition, nothing stands in the way of selecting in this region a greater diameter. Moreover, for the majority of applications especially high values for the suction capacity are not demanded in the region of the inlet of the first (high-vacuum side) pump stage. There is frequently even the necessity to reduce the suction capacity at this site. It is the essential purpose of the first pump stage to ensure a high compression ratio. The blade properties (number of turbo stages, blade spacing, angle of inclination etc.) must be designed with this in mind. Essential is the separation of the two working pressure regions of the two pump stages. As a rule, high suction capacity is only required at the intermediate inlet(s). This goal can also be attained through the selection of special blade geometries. Applying the measures according to the invention ensures precisely in this region that losses in suction capacity are largely avoided.

Critical for the suction capacity of a pump stage is the accessibility of the gas molecules to the gas inlet (effective gas penetration area). In order to attain this goal, it is known to provide in an intermediate stage a greater spacing between the preceding stage and its gas inlet. It is especially advantageous if this spacing is at least one fourth, preferably one third, of the diameter of the rotor.

BRIEF DESCRIPTION OF THE DRAWINGS

Further advantages and details of the invention will be explained in conjunction with embodiment examples depicted in FIGS. 1 and 2 wherein.

DESCRIPTION OF THE INVENTION

Figure 1:
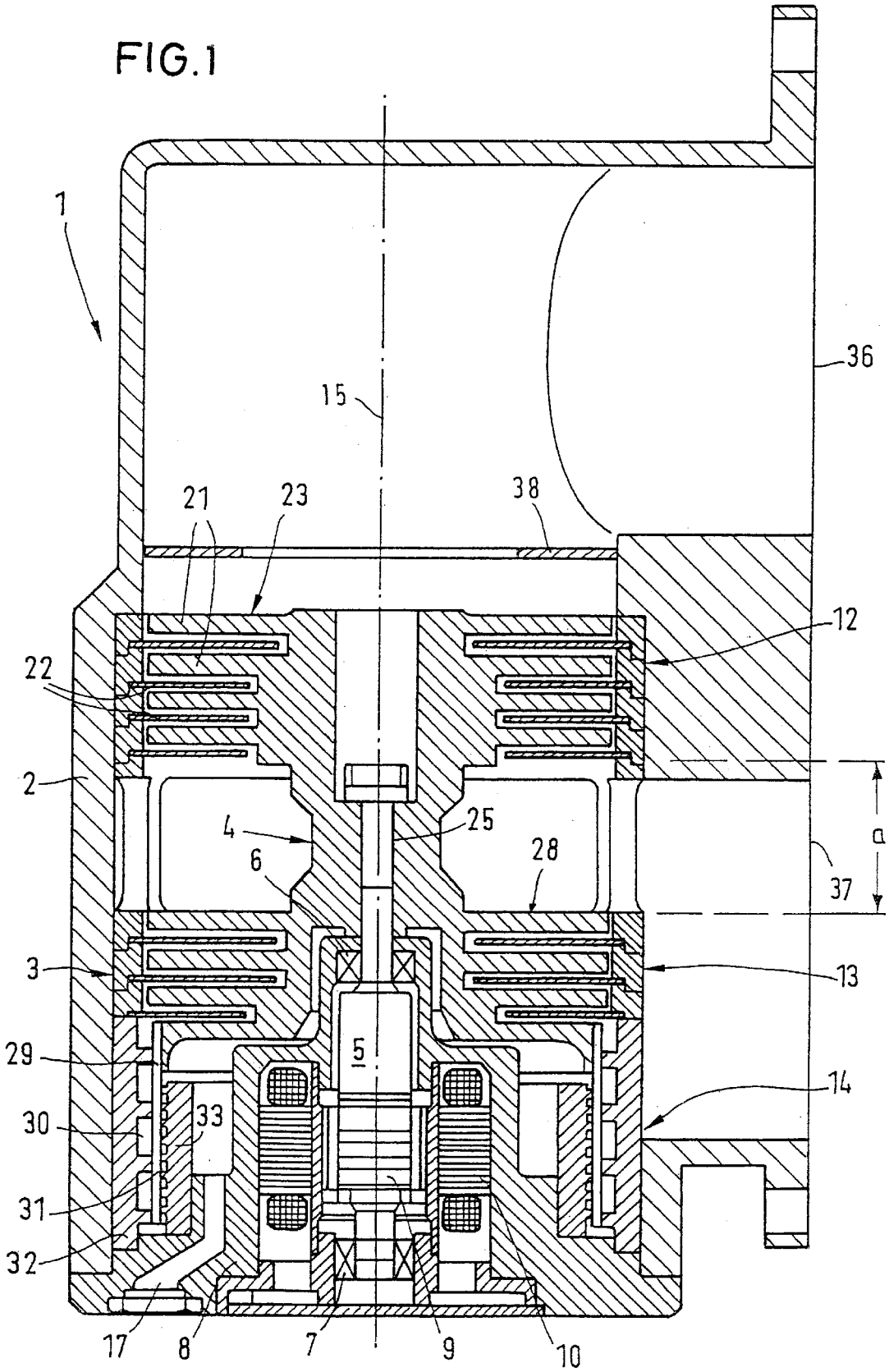
FIG. 1 is a side elevation in section illustrating a pump embodying the teachings of the present invention.

In both Figures the pump itself is denoted by 1, its housing by 2, its stator system by 3 and its rotor system by 4. The rotor system comprises the shaft 5, which, in turn, is supported via the bearings 6, 7 in the bearing housing 8 connected with the pump housing 2. In the bearing housing is disposed, in addition, the driving motor 9, 10. The rotational axis of the rotor system 4 is denoted by 15.

Overall, three pump stages 12, 13, 14 are provided, of which two (12, 13) are developed as turbomolecular vacuum pump stages and one (14) as molecular (Holweck) pump stage. Adjoining the molecular pump stage 14 is the outlet of a pump 17.

The first pump stage 12, disposed at the high-vacuum side, comprises four pairs of rotor blade rows 21 and stator blade rows 22. Its inlet, the effective gas penetration area is denoted by 23. Adjoining the first pump stage 12 is the second pump stage 13, which comprises three pairs each of a stator blade row 22 and a rotor blade row 21. Its inlet is denoted by 28.

The second pump stage 13 is spaced apart from the first pump stage 12. The selected distance (height) a ensures the free accessibility of the gas molecules to be transported to the gas inlet 28. The distance a is usefully greater than one fourth, preferably greater than one third of the diameter of the rotor system 4.

The adjoining Holweck pump comprises a rotating cylinder segment 29 which is opposed on the outside and inside in known manner by stator elements 32, 33 each equipped with a threaded groove 30, 31.

The rotor-side components of pump stages 12, 13, 14 form a unit which, in the operationally ready state are connected with the shaft 5. At the level of the interspace between the pump stages 12 and 13 the shaft 5 penetrates a central bore 25 such that no direct connection exists between the bearing space and the interspace and, consequently, the danger of back diffusion of lubricant vapors is eliminated. For this purpose serves also the taper-bore mounting of the rotor system 4. Bearings disposed at the high-vacuum side with the structural components (bearing supports) impairing conductance can be omitted. However, by developing the portion of the rotor system 4 in the proximity of the motor as a bell-shaped form, the distance of the bearing 6, 7 from the center of gravity of the rotor is kept small. The back diffusion of lubricant vapors can also be avoided by using magnet bearings which can be disposed at a more favorable site.

For the realization of the junction means according to the invention serves the housing 2 itself. In the embodiment example according to FIG. 1 it is developed such that the planes of all junction openings 36, 37 are parallel to the rotor axis 15. Thereby in particular the distance of the junction 37 to the associated gas inlet 28 is very small such that the conductance losses impairing the suction capacity of the pump stage 13 are negligible. This would also apply to every further intermediate junction disposed downstream from the intermediate junction 37/28. The diameter of the junction opening 37 here exceeds the height a by approximately the twofold. This measure also serves for decreasing the conductance losses between inlet 28 and junction opening 37.

The depicted pump 1 or its effective pumping elements (stator and rotor blades, threading stages) are usefully developed such that in the region of the junction opening 36 a pressure is generated of $10^{-4}$ to $10^{-7}$, preferably $10^{-5}$ to $10^{-6}$, and in the region of the junction opening 37 a pressure of approximately $10^{-2}$ to $10^{-4}$ mbar. This creates the necessity for the first pump stage 12 to provide a compression ratio of $10^2$ to $10^4$, preferably greater than 100. With the second pump stage a high suction capacity is to be generated (for example 200 l/s). The adjoining two-stage Holweck pump stage (29, 30; 29, 31) ensures a high fore-vacuum immunity such that customarily the suction capacity of the second pump stage is independent of the fore-vacuum pressure.

For the case that in the region of the junction opening 36 an especially high suction capacity is not required, this goal can be attained through corresponding formation of the blades of the first pump stage 12. A further feasibility comprises disposing in front of inlet 23 of the first pump stage a diaphragm 38 whose inner diameter determines the desired suction capacity.

Figure 2:
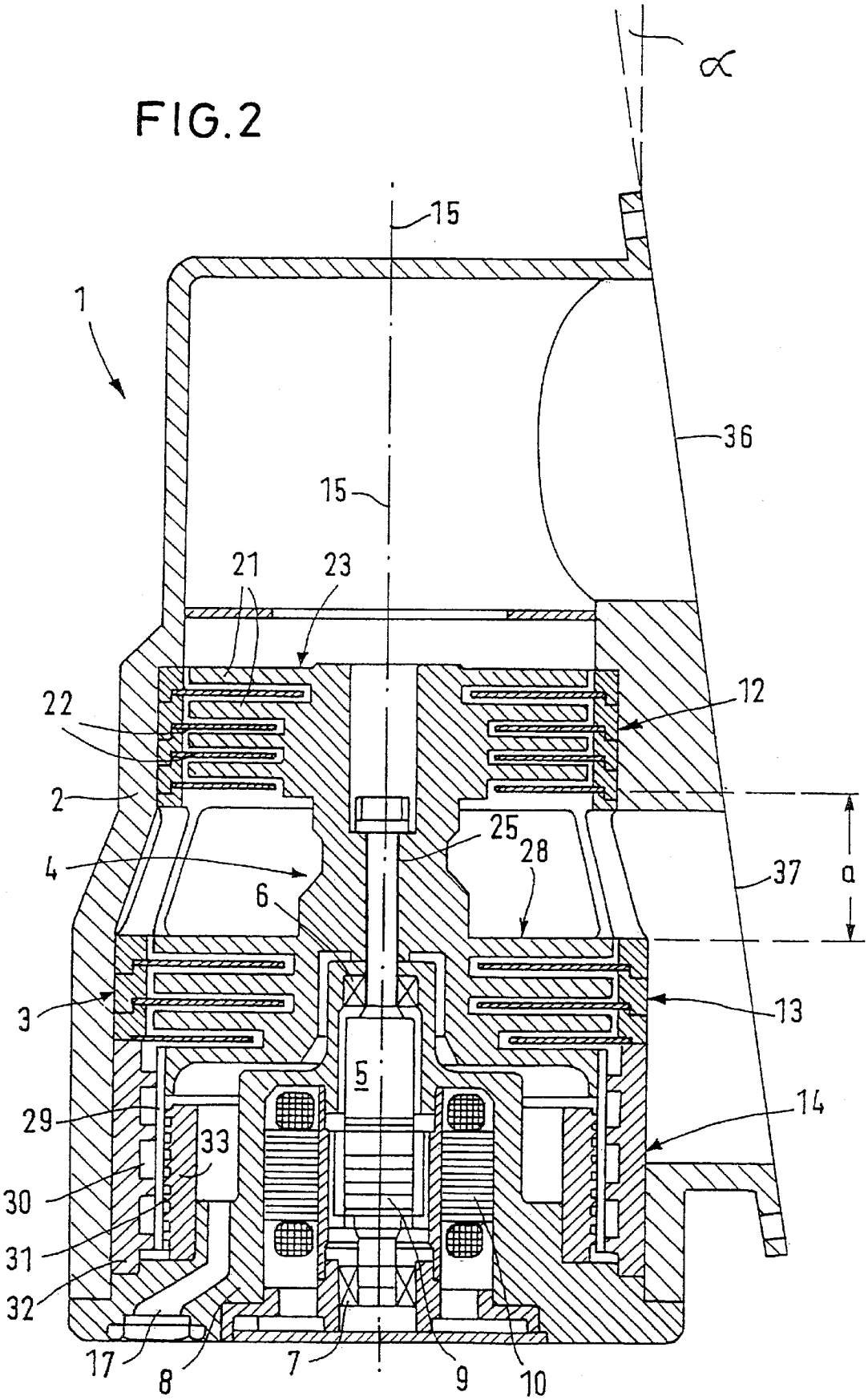
FIG. 2 is a side elevation in section illustrating a second embodiment of the invention.

The embodiment example according to FIG. 2 differs from the embodiment example according to FIG. 1 thereby that the diameter of the pump stages 13 and 14 succeeding the first pump stage 12 are greater than the diameter of pump stage 12. The plane of the junction openings 36, 37 is adapted to this structural condition. It is inclined with respect to the axis 15 of rotor 4 such that the distance of the junction openings 36, 37 to the associated gas inlets 23, 28 is as small as feasible. The angle of inclination $\alpha$ of the plane of the junction openings 36, 37 to the rotor axis 15 corresponds to the increase of the diameters of the pump stages. Optimally favorable distance conditions can thereby be attained. In the embodiment example depicted, the angle of inclination is approximately 5°.

What is claimed is:

1. Friction vacuum pump (1) with a stator (3) and a rotor (4), which form at least two pump stages (12, 13, 14) with one gas inlet (23, 28) each, as well as with junction means for the pump stages which are equipped with junction openings (36, 37) and serve for the connection of the gas inlets (23, 28) of the pump stages with devices to be evacuated, characterized in that the junction openings (36, 37) are each in a plane disposed laterally adjacent to the pump stages (12, 13, 14).

2. Friction vacuum pump as claimed in claim 1, characterized in that the planes of the junction openings (36, 37) are disposed parallel to the axis (15) of the rotor (4).

3. Friction vacuum pump as claimed in claim 1, characterized in that the junction openings (36, 37) are constituents of the housing (2) of the friction vacuum pump (1).

4. Friction vacuum pump as claimed in claim 1, characterized in that the two first pump stages (12, 13) are developed as turbomolecular pump stages and that their effective pumping elements (stator and rotor blades) are formed such that the first pump stage (12) ensures a high compression ration and that the second pump stage (13) generates a high suction capacity.

5. Friction vacuum pump as claimed in claim 4, characterized in that the two pump stages (12 and 13) are spaced apart and that their distance (a) is greater than one fourth of the rotor diameter, preferably approximately one third of the rotor diameter.

6. Friction vacuum pump as claimed in claim 5, characterized in that the diameter of that junction opening (37), which is connected via the junction means with the gas inlet (28) of the second pump stage, is greater than the distance (a), preferably approximately twice as large as the distance (a).

7. Friction vacuum pump as claimed in claim 4, characterized in that the two pump stages (12, 13) are adjoined by a two-stage Holweck pump stage.

8. Friction vacuum pump as claimed in claim 1, characterized in that the rotor (4) is driven at the fore-vacuum side and is taper-bore mounted.

9. Friction vacuum pump as claimed in claim 8, characterized in that a free shaft end penetrates a central bore (25) in the rotor (4) and that the rotor (4) is fastened on this shaft end.

10. Friction vacuum pump as claimed in claim 8, characterized in that the portion of the rotor (4) in the proximity of the motor is developed in the form of a bell.

11. Friction vacuum pump as claimed in claim 1, characterized in that with the inlet (23) of the first pump stage (12) is associated a diaphragm (38) for limiting the suction capacity.

12. Friction vacuum pump as claimed in claim 1, characterized in that it is equipped with magnet bearings.

13. A friction vacuum pump as set forth in claim 1, wherein said junction openings are in a common plane.

14. Friction vacuum pump as claimed in claim 13, characterized in that the diameter of succeeding pump stages (13, 14) is greater than the diameter of preceding pump stages (12, 13) and that the inclination of the plane of the junction openings (36, 37) with respect to the direction of axis (15) of the rotor (4) is adapted to the increase in the diameter.

15. A friction vacuum pump as set forth in claim 13, wherein said common plane is disposed parallel to the axis of the rotor.

16. A friction pump as set forth in claim 13, wherein said common plane is disposed at an angle from a plane which is parallel to the axis of the rotor.

* * * * *